United States Patent [19]

Elrod

[11] Patent Number: 4,998,736

[45] Date of Patent: Mar. 12, 1991

[54] METHOD OF PLAYING A QUESTION AND ANSWER BOARD GAME

[76] Inventor: R. Brent Elrod, 2020 Tenth St. North, St. Petersburg, Fla. 33704

[21] Appl. No.: 556,832

[22] Filed: Jul. 23, 1990

Related U.S. Application Data

[63] Continuation of Ser. No. 399,306, Aug. 28, 1989.

[51] Int. Cl.[5] ..... A63F 3/00

[52] U.S. Cl. ..... 273/249; 273/290; 273/256

[58] Field of Search ..... 273/249-254, 273/243, 256, 290

[56] References Cited

U.S. PATENT DOCUMENTS

| | | | |
|---|---|---|---|
| 4,029,320 | 6/1977 | Hausman | 273/249 |
| 4,109,918 | 8/1978 | Mele et al. | 273/256 |
| 4,121,823 | 10/1978 | McBride | 273/249 |
| 4,787,639 | 11/1988 | Ross | 273/249 |

FOREIGN PATENT DOCUMENTS

| | | | |
|---|---|---|---|
| 1120642 | 7/1968 | United Kingdom | 273/256 |
| 1187977 | 4/1970 | United Kingdom | 273/256 |
| 2198361 | 6/1988 | United Kingdom | 273/249 |

OTHER PUBLICATIONS

"Trivial Pursuit", Master Game-Rules of Play, Selchow & Righter Co., 1981, Found in Group 330 Search Room.

"Play It Again Jukebox", Games Magazine, Feb. 1986, p. 48, Found in Group 330 Search Room.

*Primary Examiner*—Benjamin Layno

*Attorney, Agent, or Firm*—Herbert W. Larson

[57] ABSTRACT

The game contains a board with multiple spaces on which a concert platform playing piece moves for each player from a start box to a final stage. Each space contains instructions which may include selecting a rescue or challenge card. The rescue cards provide a means for escaping precarious predicaments and the challenge cards may ask questions which if answered correctly provides a bonus and if answered incorrectly a monetary penalty. A pair of dice determines the number of spaces moved during each player's turn. Each player can obtain band members to be inserted on their playing piece. Such band members are worth $50,000 each at the conclusion of the game when each player arrives at the final stage. The player who accumulates the most money is declared the winner.

5 Claims, 2 Drawing Sheets

METHOD OF PLAYING A QUESTION AND ANSWER BOARD GAME

Prior Applications. This application is a continuation of my application Ser. No. 07/399,306, filed Aug. 28, 1989.

BACKGROUND OF THE INVENTION

1. Field of the Invention

This invention relates to board games. More particularly, it refers to a competitive game of chance in which pieces move onto spaces of a board and each space describes an action to be taken.

2. Description of the Prior Art

Board games of various types in the prior art have provided entertainment for players. These board games have a great diversity from real estate sales games such as MONOPOLY to war games such as RISK. Board games continue to be of interest to the public and new games are frequently met with enthusiastic response. For this reason, many new board games reach the market place each year.

SUMMARY OF THE INVENTION

I have developed a novel board game having one hundred and eighteen enclosed spaces on the board forming a contiguous path around the board from a start box to a "final stage". Five intermediate "stage" boxes are interspersed among the enclosed spaces. Each enclosed space contains intructions concerning the action to be taken by the player whose piece lands on the space. A throw of a pair of dice determines the moves of a player piece.

Six concert platforms of different colors are used as moving pieces by up to six players. Fifty challenge cards and fifty rescue cards are used as the tactics of the game requires or when directed by instructions on a space landed upon by a player piece. A supply of playing money is provided each player. Thirty-five band members are available for insertion into the concert platform playing pieces. No more than five different players can be placed on a single platform.

The object of the game is to become the headline act on the final stage by moving through the various spaces on the board and by recalling and announcing names of musical artists. By movement of the concert platform pieces, adding band members and performing concerts money can be accumulated. Each player selects a different colored concert platform and two band members to start the game. Play continues until all players' pieces reach the final stage. At the final stage, band members are returned to the board at a value of fifty-thousand dollars each. The player who has accumulated the most cash is declared the winner.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
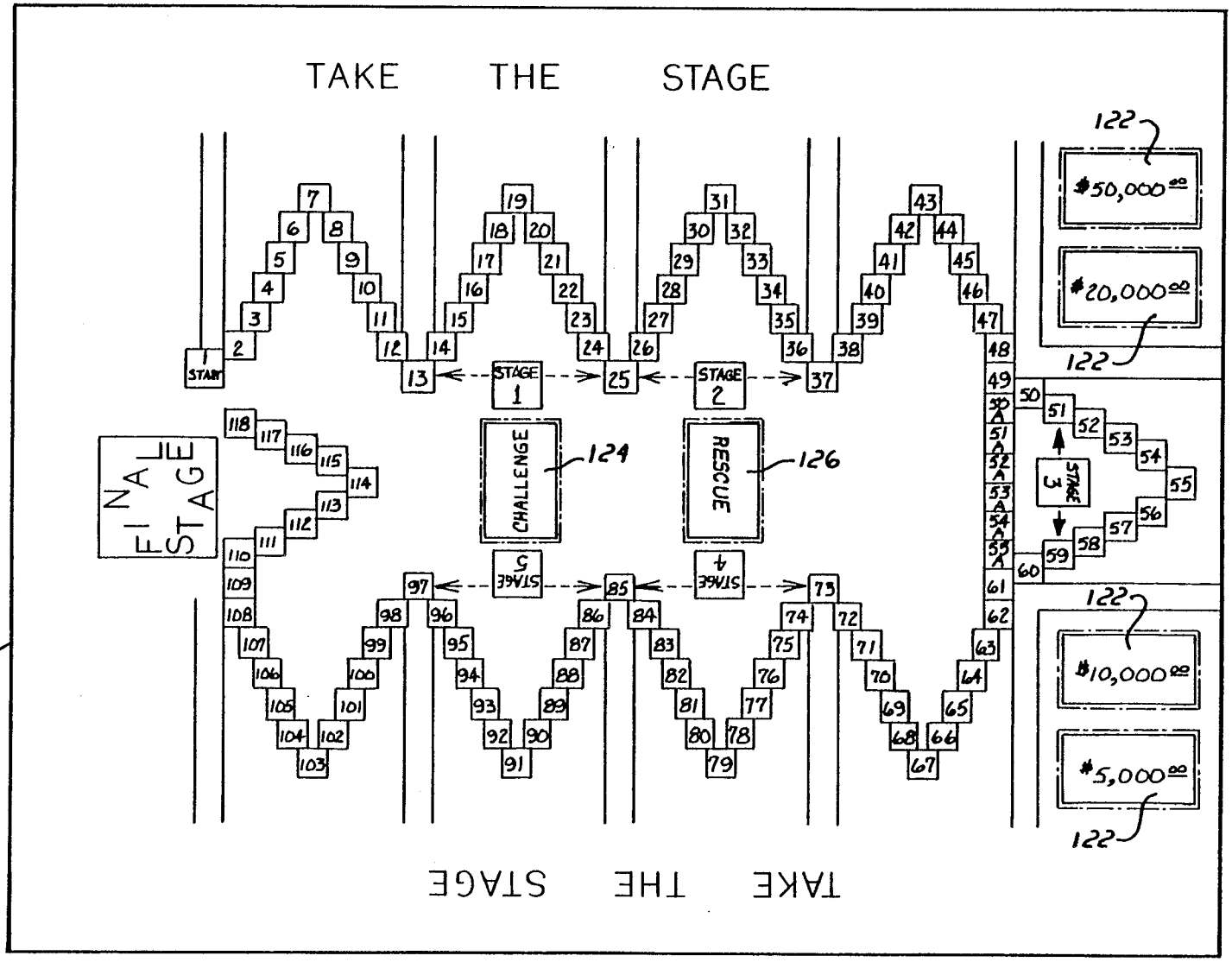
FIG. 1 is a plan view of the board employed in the game.
Figure 2:
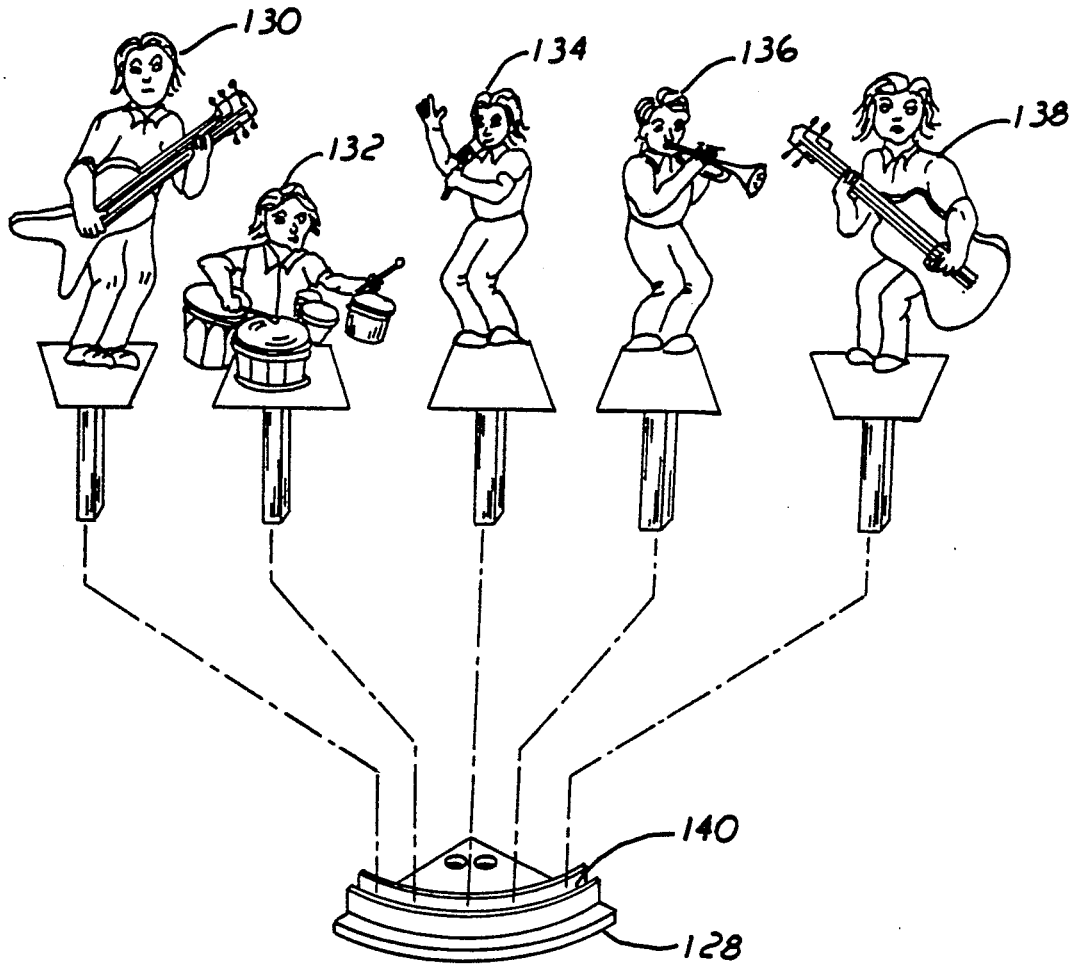
FIG. 2 is a front elevation view of a player moving piece and the five band members.
Figure 3:
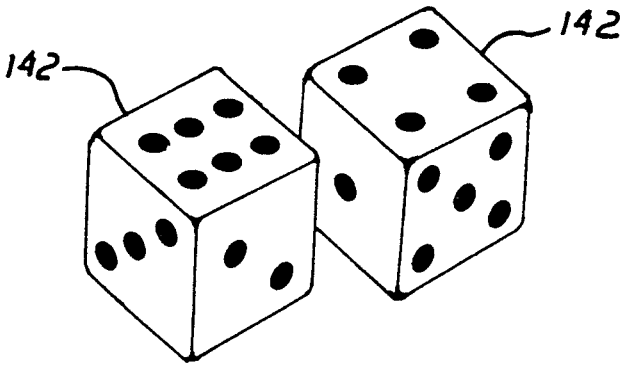
FIG. 3 is a perspective view of the conventional dice used to move the player pieces.

Throughout the following detailed description, the same reference numerals refer to the same elements in all figures.

The board 120 shown in FIG. 1 has playing spaces 1 to 118 including alternate route 50A–55A. The spaces contain directions for play of the game as follows:

1. START
2. ADVERTISE FOR BAND MEMBERS. PAY $5000
3. BUY FRONT ROW SEATS FOR AN UPCOMING CONCERT. PAY $5000
4. HOST A PRECONCERT PARTY. PAY $5000
5. PURCHASE A NEW STEREO SYSTEM. PAY $5000
6. WIN A CONCERT PACKAGE FROM THE LOCAL RADIO STATION. COLLECT $5000
7. AUDITION BASS PLAYERS FOR THE GROUP. ADD ANY PIECE
8. GET STUCK IN CONCERT TRAFFIC. LOSE A TURN
9. BUY A NEW GUITAR. PAY $5000
10. SCHEDULE REHEARSALS. ADD ANY PIECE
11. AN OLD FRIEND JOINS THE BAND. ADD ANY PIECE
12. THE BAND MUST OVERCOME MANY OBSTACLES. DRAW A CHALLENGE CARD
13. INVEST IN A SPANDEX WARDROBE. PAY $10,000
14. ENTER A LOCAL TALENT SHOW - AND WIN! COLLECT $10,000
15. THE LEAD SINGER FROM ANOTHER GROUP JOINS YOURS. FROM ANY OPPONENT, TAKE ANY PIECE
16. PRACTICE MAKES PERFECT. DRAW A CHALLENGE CARD
17. ADVANCE TO STAGE #1. SING A PORTION OF A SONG BY THE NAMED ARTIST
18. WIN A RADIO SPONSORED RECORDING SESSION. COLLECT $25,000
19. REHEARSALS ARE A BUST. RETURN A PIECE
20. AUDITION DRUMMERS FOR THE GROUP. ADD ANY PIECE
21. THE BAND BUYS NEW RECORDING EQUIPMENT. PAY $10,000
22. THE BAND LANDS ITS FIRST GIG! COLLECT $10,000
23. BOOS AND HISSES GREET THE BANDS FIRST PERFORMANCE. DRAW A RESCUE CARD
24. THE GROUP NEEDS POLISHING. ADD ANY PIECE
25. A LOCAL BUSINESS HIRES THE BAND TO COMPOSE MUSIC FOR A JINGLE. COLLECT $5000
26. THE LEAD SINGER AGREES TO TRY BACKUP VOCALS. GO BACK THREE SPACES
27. ADVANCE TO STAGE #2. NAME A SONG BY THE NAMED ARTIST
28. THE BAND TRIES A DIFFERENT LOOK. ADD ANY PIECE
29. UPGRADE YOUR SOUND SYSTEM. PAY $10,000

30. WIN A BATTLE OF THE BANDS COMPETITION. DRAW A CHALLENGE CARD
31. THE BAND BECOMES A FIXTURE ON THE LOCAL CLUB SCENE. COLLECT $10,000
32. YOUR SUCCESS IS OFTEN AT ANOTHER'S EXPENSE. FROM ANY OPPONENT. TAKE $10,000
33. THE BAND RECORDS A DEMO TAPE. PAY $5000
34. THE BAND ATTRACTS AN ANONYMOUS SUPPORTER. COLLECT $10,000
35. THE BAND PERFORMS ITS JINGLE AT A LOCAL SALES EVENT. COLLECT $5000
36. PURCHASE A VAN TO HAUL YOUR EQUIPMENT. PAY $25,000
37. EQUIPMENT PROBLEMS ARISE AT A CLUB SHOW. LOSE A TURN
38. RETURN TO STAGE #2. SING A PORTION OF A SONG BY THE NAMED ARTIST
39. THE BAND PLAYS ITS FIRST REGIONAL DATE! COLLECT $25,000
40. FANS RUSH THE STAGE. TO HIRE ADDITIONAL SECURITY, PAY $10,000
41. THE BAND DECIDES TO TRY A BIGGER LINEUP. ADD ANY PIECE
42. A SINGLE FROM YOUR DEMO RECEIVES LOCAL AIRPLAY. DRAW A CHALLENGE CARD
43. YOUR DRUMMER IS KNOCKED SENSELESS BY A FLYING COWBELL. RETURN A PIECE
44. DEMAND FOR THE GROUP RUNS HIGH. COLLECT $25,000
45. COMPETITION FOR QUALITY BAND MEMBERS IS INTENSE. FROM ANY OPPONENT, TAKE ANY PIECE
46. THE BAND RELEASES ITS FIRST SINGLE! COLLECT $50,000
47. ADVANCE TO STAGE #3. SING A PORTION OF A SONG BY THE NAMED ARTIST
48. SHORE UP THE BAND' WEAK SPOTS. ADD TWO PIECES
49. HIRE A MANAGER TO PROMOTE THE GROUP. PAY $10,000
50. PERFORM AT A CHARITY EVENT. DRAW A CHALLENGE CARD.
50A. RECORD A HOME VIDEO FOR USE IN PROMOTING THE BAND. PAY $5000
51A. YOUR MANAGER ORDERS A NEW LOOK: COSTUMES! PAY $10,000
52A. LOCAL AIRPLAY OF YOUR SINGLE GENERATES MAJOR LABEL INTEREST. COLLECT $25,000
53A. YOUR SINGLE DISAPPEARS FROM THE RADIO. SO DO YOU . . . LOSE A TURN
54A YOUR RECORD LABEL REJECTS THE ARTWORK FOR YOUR ALBUM COVER. DRAW A RESCUE CARD 55A. FAN MAIL IS OVERWHELMING. ASSISTANTS ARE HIRED TO ANSWER IT ALL. PAY $20,000
51. NEW MEMBERS GENERATE NEW EXCITMENT. GO FORWARD THREE SPACES
52. AN EXTENDED TOUR OF REGIONAL CLUBS IS WELL RECEIVED. COLLECT $25,000
53. YOUR BIGGEST FANS HOST A FUND RAISING PARTY. COLLECT $5000
54. AN INDEPENDENT LABEL SIGNS YOU TO A RECORDING CONTRACTS! COLLECT $50,000
55. EQUIPMENT IS STOLEN BACKSTAGE. TO REPLACE IT, PAY $25,000
56. A LOCAL CONCERT CRITIC GIVES THE BAND A TERRIBLE REVIEW. DRAW A RESCUE CARD
57. STUDIO PLAYERS ARE NEEDED FOR A RECORDING SESSION. ADD TWO PIECES
58. A MANAGER CHANGE BENEFITS THE GROUP. COLLECT $5000
59. THE GROUP IS FAST BECOMING THE CRITICS' FAVORITE. ROLL AGAIN
60. YOU ARE HIRED TO TOUR THE COUNTRY AS AN OPENING ACT! COLLECT $50,000
61. RETURN TO STAGE #3. NAME A SONG BY THE NAMED ARTIST
62. THE BAND IS CITED FOR VIOLATING A CITY NOISE ORDINANCE. PAY $5000
63. THE BAND TAKES OUT A BANK LOAN TO OFFSET A SLUMP IN BOOKINGS. COLLECT $25,000
64. COLLABORATE WITH OTHER SUPERSTARS ON A BENEFIT ALBUM. DRAW A CHALLENGE CARD
65. THE BASS PLAYER TAKES OFF ONE TOO MANY ARTICLES OF CLOTHING. TO POST BOND, PAY $10,000
66. THE BAND STEALS THE SHOW AS THE OPENING ACT. FROM EACH OPPONENT, TAKE $5000
67. YOUR DRUMMER WANTS THE SONGS HE WROTE TO GO ON THE NEXT ALBUM. RETURN A PIECE
68. THE MUSIC LACKS SPARK. ADD ANY PIECE
69. THE DRUMMER IS DATING A HAIRSTYLIST. PERMS ARE FREE! DRAW A RESCUE CARD
70. YOUR ALBUM SPAWNS A HIT! COLLECT $50,000
71. THE BAND UPHOLDS ITS REPUTATION FOR DESTROYING HOTEL ROOMS. FOR REPAIRS, PAY $20,000
72. ADVANCE TO STAGE #4. SING A PORTION OF A SONG BY THE NAMED ARTIST
73. PLAY YOUR HOMETOWN ARENA. BUY TICKETS FOR EVERYONE YOU KNOW. PAY $5000
74. AN OUTDOOR SHOW IS RAINED OUT. LOSE A TURN
75. SIGN AUTOGRAPHS AT A RECORD STORE. COLLECT $5000
76. HIRE AN ACCOUNTANT TO KEEP THE BOOKS. PAY $10,000
77. A MAJOR RECORD LABEL SIGNS YOU TO AN EXTENDED CONTRACT. COLLECT $100,000
78. THE BAND IS ACCUSED OF STEALING A SONG, BAD PUBLICITY RESULTS. TO CLEAR YOUR NAME, PAY $50,000
79. YOUR MANAGER SENSES YOU ARE PLANNING TO FIRE HIM. HE VANISHES WITH TOUR PROCEEDS. PAY $50,000
80. A POSTER OF THE BAND IS PRINTED. COLLECT $50,000

81. YOUR SECOND ALBUM ENTERS THE CHARTS WITH A BULLET! ADD ANY PIECE
82. YOUR MANAGER IS CONVINCED THE BAND SHOULD DO A COMMERCIAL . . . GO BACK THREE SPACES
83. THE BAND PRODUCES ITS FIRST VIDEO. PAY $50,000
84. THE BAND SELLS OUT AND DOES A BEER COMMERCIAL. COLLECT $50,000
85. ADVANCE TO STAGE #5. NAME TWO OF THE NAMED ARTISTS' SONGS
86. THE BAND BUYS ITS OWN TOUR BUS. PAY $50,000
87. YOUR ALBUM GOES GOLD!!! COLLECT $100,000
88. YOUR SINGLE GOES TO NUMBER ONE!!! COLLECT $100,000
89. THE DRUMMER FALLS OFF THE STAGE AND BREAKS HIS ARM. RETURN A PIECE
90. THE BAND IS PROMOTED TO HEADLINE STATUS !!! COLLECT $50,000
91. THE BAND IS NOMINATED FOR A GRAMMY AWARD! COLLECT $50,000
92. YOUR VIDEO MOVES INTO HEAVY ROTATION! COLLECT $100,000
93. THE ROAD CREW STRIKES FOR HIGHER WAGES. TO GET THEM BACK TO WORK, PAY $50,000
94. YOUR VIDEO IS PLAYED ONLY WHEN NO ONE IS WATCHING . . . LOSE A TURN
95. THE GROUPS' SECOND ALBUM IS A DUD. RETURN A PIECE
96. THE BAND MAKES THE COVER OF ROLLING STONE! COLLECT $100,000
97. YOUR DRUMMER IS ELECTROCUTED IN A FREAK, BACKSTAGE ACCIDENT. RETURN A PIECE
98. HIRE A LAWYER TO SUE YOUR EX-MANAGER. PAY $50,000
99. RETURN TO STAGE #5. SING A PORTION OF A SONG BY THE NAMED ARTIST
100. THE BAND SPLITS UP TO PURSUE SOLO CAREERS. RETURN ALL BUT ONE PIECE AND GO FORWARD THREE SPACES
101. RETURN TO YOUR ROOTS. PLAY A FREE CONCERT FOR YOUR HOMETOWN FANS. DRAW A RESCUE CARD
102. YOUR DRUMMER ENTERS DRUG AND ALCOHOL REHABILITATION. RETURN A PIECE
103. YOUR NEW SOLO CAREER IS WELL RECEIVED. COLLECT $50,000
104. HOST THE VIDEO MUSIC AWARDS. COLLECT $25,000
105. PRODUCTION COSTS GO WAY OVER BUDGET. PAY $50,000
106. YOUR DRUMMER DESTROYS A DRUMSET ON STAGE. FOR A NEW SET, PAY $10,000
107. THE BAND CONTRIBUTES A SONG TO A MOVIE SOUNDTRACK. COLLECT $100,000
108. TURN IN ANY COMBINATION OF RESCUE AND CHALLENGE CARDS TOTALING THREE. COLLECT $100,000
109. EX-MEMBERS OF THE BAND ARE WELCOMED BACK FOR A REUNION TOUR. ADD TWO PIECES
110. THE BAND WINS A GRAMMY AWARD! COLLECT $150,000
111. RENOUNCE YOUR WEALTH AND MOVE TO NEPAL. PAY $100,000
112. WIN "BEST VIDEO" AT THE MUSIC AWARDS!!! COLLECT $100,000
113. TOUR OVERSEAS! COLLECT $100,000
114. AN OBSCURE "B-SIDE" OF A SINGLE BECOMES AN UNEXPECTED HIT! COLLECT $50,000
115. NEW SYNTHESIZER EQUIPMENT MAKES YOUR DRUMMER OBSOLETE. RETURN A PIECE
116. YOUR STADIUM CONCERT TOUR IS A SELL-OUT!! COLLECT $200,000
117. UH, OH! THE OPENING ACT STOLE YOUR SHOW. TO GET RID OF THEM, PAY $50,000
118. YOUR ALBUM IS CERTIFIED PLATINUM!!!!!!! COLLECT $250,000

Play money 122 in denominations of $5,000.00, $10,000.00, $20,000.00 and $50,000.00 is used in the game. At the start of the game, a Banker is designated by the players and the money 122 is distributed by him/her. The Banker places a $20,000.00 on each Stage space and gives each player three $20,000.00, two $10,000.00 and four $5,000.00 bills. The Banker also deals three Challenge cards 124 and two Rescue cards 126 from stacks containing fifty challenge 124 and Rescue cards 126.

At the start of the game, each player selects a different colored concert platform 128 to act as his moving piece. Out of a pool of thirty-five band members 130, 132, 134, 136 and 138, each player selects two to form a band. The players are inserted into a curved slot 140 located in the concert platform 128.

Each player rolls one die 142 with the highest roller going first and the player to his or her left following so that play continues among the players in a clockwise rotation.

The object of the game is for one player to become the Headline Act on the Final Stage. This is achieved by amassing the most amount of money at the time the player reaches the Final Stage space on the board 120. During the game, players move their concert platforms clockwise over the spaces 1–118 by naming musical artists, adding band members, exercising turn options and following the board's instructions.

Play continues until all competitors reach the Final Stage. An exact roll of the dice is not needed to reach this space. After a player has reached the Final Stage, all other players roll out until they too have reached this space. Board instructions are followed but players are no longer required to name musical artists nor allowed to play Challenge 124 and Rescue 126 cards. Once all players are on the Final Stage, band member pieces are returned to the Bank. Players collect $50,000 for each piece exchanged. All players then total their cash to determine the winner.

The player with the most money is declared the Headline Act!!! Second place is dubbed the Opening Act. Third place is granted a Backstage Pass. Fourth place is seated on the Front Row. Fifth place is hired to take tickets. Sixth or last is relegated to the Road Crew and must break down the Stage and store it away!

The first step of any turn is to state the name of a musical artist aloud. After successfully completing this requirement, a player then:

(a) rolls the dice 142 and moves the concert platform 128 the corresponding number of spaces and performs as the board directs (should the board direct the player to draw a Challenge 124 or Rescue 126 card, the players' turn is automatically ended);

(b) plays either one Challenge 124 or one Rescue 126 card (unless a Rescue 126 card was submitted to name a musical artist to begin the turn);

(c) draws either one Challenge 124 or one Rescue 126 card to conclude the turn.

Moves (a) and (c) are mandatory requirements of a turn. Move (c) would be included in move (a) if the board directed the player to draw a Challenge 124 or Rescue 126 card. Move (b) is optional. Doubles do NOT roll again.

High roller begins the game by naming a band or musical artist whose first word begins with the letter 'A' (Example: "Aardvark"). Should the player be unable to announce a musical artist beginning with 'A', the player must submit a Rescue 126 card from his/her hand to aid in naming an alternative musical artist. Allow sixty seconds for the initial response and an additional sixty seconds should a Rescue 126 card be played. The game will flow smoothly when time constraints are enforced. After successfully naming a musical artist, Player 1 then exercises his moves (a), (b) and (c).

Subsequent players begin their turns by naming a band/artist whose first word begins with the last letter of the band previously named. (Example: Player 2 would take the 'K' from "Aardvark" and possibly name "Kay Smith". Player 3 would later use the 'H' from "Kay Smith" and name a musical artist whose first word begins with 'H'; and so on.) If a player is unable to name a band/artist within a reasonable time, the player must exercise a Rescue 126 card to assist in doing so.

When a Rescue card is submitted to aid in naming an alternative band/artist, the next player shall use the last letter of that musical artists' name to begin the next turn.

After naming a band/artist, the player then exercises the turn options (a), (b) and (c) set forth above.

The fifty Rescue 126 cards have the following content:

Six cards—"STAGE FRIGHT"

Two cards—"RESCUE ME FROM LOSING A BAND MEMBER ADD A BAND MEMBER"

One card—"RESCUE ME FROM MY EXPENSES COLLECT $10,000"

Two cards—"RESCUE ME FROM TIME TAKE AN ADDITIONAL SIXTY SECONDS"

One card—"RESCUE ME FROM A SMALL BANK ACCOUNT COLLECT $20,000"

Two cards—"RESCUE ME FROM TOO MANY CARDS TURN IN THIS AND ANY TWO OTHERS COLLECT $25,000"

One card—"RESCUE ME FROM CREDITORS COLLECT $5000"

Two cards—"RESCUE ME FROM MY BOARD MOVE DO NOT HEED THE BOARD'S REQUEST"

Two cards—"BLOCK A 'TAKE A RESCUE'"

Two cards—"BLOCK A 'LOSE A TURN' CARD"

Two cards—"BLOCK A 'TAKE A CHALLENGE'"

Four cards—"CRITICS CHOICE"

One card—"NAME A COUNTRY ARTIST PAY $5000 TO THE BANK"

One card—"NAME A REGGAE ARTIST PAY $5000 TO THE BANK"

One card—"NAME A JAZZ OR A NEW AGE ARTIST PAY $5000 TO THE BANK"

One card—"NAME A SOLO ARTIST PAY $5000 TO THE BANK"

One card—"NAME A DUET PAY $5000 TO THE BANK"

One card—"NAME A TRIO PAY $5000 TO THE BANK"

One card—"NAME A CLASSICAL ARTIST PAY $5000 TO THE BANK"

Two cards—"NAME A BAND/ARTIST WHOSE FIRST WORD BEGINS WITH EITHER 'A', 'B', OR 'C' PAY $5000 TO THE BANK Two cards—"NAME A BAND/ARTIST WHOSE FIRST WORD BEGINS WITH EITHER 'D', 'E', OR 'F' PAY $5000 TO THE BANK"

Two cards—"NAME A BAND/ARTIST WHOSE FIRST WORD BEGINS WITH EITHER 'G', 'H', OR 'I' PAY $5000 TO THE BANK"

Two cards—"NAME A BAND/ARTIST WHOSE FIRST WORD BEGINS WITH EITHER 'J', 'K', OR 'L' PAY $5000 TO THE BANK"

Two cards—"NAME A BAND/ARTIST WHOSE FIRST WORD BEGINS WITH EITHER 'M', 'N', OR 'O' PAY $5000TO THE BANK"

Two cards—"NAME A BAND/ARTIST WHOSE FIRST WORD BEGINS WITH EITHER 'P', 'Q', OR 'R' PAY $5000 TO THE BANK"

Two cards—"NAME A BAND/ARTIST WHOSE FIRST WORD BEGINS WITH EITHER 'S', 'T', OR 'U' PAY $5000 TO THE BANK"

Two cards—"NAME A BAND/ARTIST WHOSE FIRST WORD BEGINS WITH EITHER 'V', 'W', 'X', 'Y', OR 'Z' PAY $5000 TO THE BANK"

The fifty challenge 124 cards have the following content:

One card—"SELF-CHALLENGE NAME THREE ADDITIONAL ARTISTS USING THE LETTERS 'A', 'B', AND/OR 'C' TAKE $10,000 FROM BANK IF SUCCESSFUL PAY $10,000 TO THE BANK IF UNSUCCESSFUL"

One card—"SELF-CHALLENGE NAME THREE ADDITIONAL ARTISTS USING THE LETTERS 'D', 'E', AND/OR 'F' TAKE $10,000 FROM BANK IF SUCCESSFUL PAY $10,000 TO BANK IF UNSUCCESSFUL"

One card—"SELF-CHALLENGE NAME THREE ADDITIONAL ARTISTS USING THE LETTERS 'G', 'H' AND/OR 'I' TAKE $10,000 FROM BANK IF SUCCESSFUL PAY $10,000 TO BANK IF UNSUCCESSFUL"

One card—"SELF-CHALLENGE NAME THREE ADDITIONAL ARTISTS USING THE LETTERS 'J', 'K', AND/OR 'L' TAKE $10,000 FROM BANK IF SUCCESSFUL PAY $10,000 TO BANK IF UNSUCCESSFUL"

One card—"SELF-CHALLENGE NAME THREE ADDITIONAL ARTISTS USING THE LETTERS 'M', 'N', AND/OR 'O' TAKE $10,000 FROM BANK IF SUCCESSFUL PAY $10,000 TO BANK IF UNSUCCESSFUL"

One card—"SELF-CHALLENGE NAME THREE ADDITIONAL ARTISTS USING THE LETTERS 'P', 'Q', AND/OR 'R' TAKE $10,000 FROM BANK IF SUCCESSFUL PAY $10,000 TO BANK IF UNSUCCESSFUL"

One card—"SELF-CHALLENGE NAME THREE ADDITIONAL ARTISTS USING THE LETTERS 'S', 'T', AND/OR 'U' TAKE $10,000 FROM BANK IF SUCCESSFUL PAY $10,000 TO BANK IF UNSUCCESSFUL"

One card—"SELF-CHALLENGE NAME THREE ADDITIONAL ARTISTS USING THE LETTERS 'V', 'W', 'X', 'Y', AND/OR 'Z' TAKE $10,000 FROM BANK IF SUCCESSFUL PAY $10,000 TO BANK IF UNSUCCESSFUL"

One card—"CHALLENGE AN OPPONENT TO NAME THREE ADDITIONAL ARTISTS USING THE LETTERS 'A', 'B', AND/OR 'C' BOTH TAKE $10,000 FROM BANK IS SUCCESSFUL IF UNSUCCESSFUL, OPPONENT PAYS BANK $10,000"

One card—"CHALLENGE AN OPPONENT TO NAME THREE ADDITIONAL ARTISTS USING THE LETTERS 'D', 'E', AND/OR 'F' BOTH TAKE $10,000 FROM BANK IF SUCCESSFUL IF UNSUCCESSFUL, OPPONENT PAYS BANK $10,000"

One card—"CHALLENGE AN OPPONENT TO NAME THREE ADDITIONAL ARTISTS USING THE LETTERS 'G', 'H', AND/OR 'I' BOTH TAKE $10,000 FROM BANK IF SUCCESSFUL IF UNSUCCESSFUL, OPPONENT PAYS BANK $10,000"

One card—"CHALLENGE AN OPPONENT TO NAME THREE ADDITIONAL ARTISTS USING THE LETTERS 'J', 'K', AND/OR 'L' BOTH TAKE $10,000 FROM BANK IF SUCCESSFUL IF UNSUCCESSFUL, OPPONENT PAYS BANK $10,000"

One card—"CHALLENGE AN OPPONENT TO NAME THREE ADDITIONAL ARTISTS USING THE LETTERS 'M', 'N', AND/OR 'O' BOTH TAKE $10,000 FROM BANK IF SUCCESSFUL IF UNSUCCESSFUL, OPPONENT PAYS BANK $10,000"

One card—"CHALLENGE AN OPPONENT TO NAME THREE ADDITIONAL ARTISTS USING THE LETTERS 'P', 'Q', AND/OR 'R' BOTH TAKE $10,000 FROM BANK IF SUCCESSFUL IF UNSUCCESSFUL, OPPONENT PAYS BANK $10,000"

One card—"CHALLENGE AN OPPONENT TO NAME THREE ADDITIONAL ARTISTS USING THE LETTERS 'S', 'T', AND/OR 'U' BOTH TAKE $10,000 FROM BANK IF SUCCESSFUL IF UNSUCCESSFUL, OPPONENT PAYS BANK $10,000"

One card—"CHALLENGE AN OPPONENT TO NAME THREE ADDITIONAL ARTISTS USING THE LETTERS 'V', 'W', 'X', 'Y', 'Z' BOTH TAKE $10,000 FROM BANK IF SUCCESSFUL IF UNSUCCESSFUL, OPPONENT PAYS BANK $10,000"

Two cards—"LOSE A TURN"

One card—"FROM ANY OPPONENT, TAKE $5000"

One card—"FROM ANY OPPONENT, TAKE $10,000"

Two cards—"MOVE AN OPPONENT BACK THREE SPACES"

Two cards—"MOVE AN OPPONENT THREE ADDITIONAL SPACES"

Two cards—"MOVE YOURSELF THREE ADDITIONAL SPACES"

Four cards—"BATTLE OF THE BANDS"

Two cards—"TAKE AN OPPONENTS' RESCUE CARD"

Two cards—"TAKE AN OPPONENTS' CHALLENGE CARD"

Two cards—"TAKE AN OPPONENTS' BAND MEMBER"

Three cards—"TAKE THE STAGE NAME FIVE STYLES OF MUSIC (EACH CAN BE NAMED ONCE ONLY)"

Three cards—"TAKE THE STAGE SING A PORTION OF A SONG BY THE NAMED ARTIST"

Three cards—"TAKE THE STAGE NAME A SONG BY THE BAND/ARTIST"

Two cards—"TAKE THE STAGE NAME A MEMBER OF THE GROUP"

Three cards—"TAKE THE STAGE NAME OR SING A PORTION OF A CURRENT TOP TWENTY SONG"

The guidelines that follow apply some restrictions to the naming of musical artists. All players should familiarize themselves with these restrictions.

Select a Critic to record a written list of all bands and artists whose names are used during play. All types of musical artists can be called upon in a game unless otherwise restricted prior to the onset of play. In other words, a player could name a current pop star in one round, a classical or country artist in the next, and so on. Individual players can not keep separate lists.

Should a player fail to successfully name a group/artist within a reasonable time, nor successfully submit a Rescue card, the player is immediately disqualified from further play. Each band/artist may be named once only. It is acceptable to name both a musical group and its individual members.

Should a player announce a previously named group/artist during a turn, any opposing player can immediately challenge the error. No challenge card is needed. Should a review of the Critic's List (and this is the only time players may consult the list) find a musical artist's name has been repeated, the challenged player must pay a $5000 penalty. This money is placed on the Final Stage for the player reaching that space first to collect. Should the challenge prove unwarranted, the challenging player must pay a $5000 penalty to the Final Stage. The challenged player must then name an alternative band/artist to continue their turn.

Many band names end in the letter 'S'. When this occurs in normal rotation, the next player shall start their turn by naming a musical artist whose first word begins with the letter preceding the 'S'. In other words, drop the 'S' and use the "new" last letter. (Example: "Anteaters" would be classified as "Anteater" and the letter 'R' used by the next player.)

Should an individual artist's name end in the letter 'S' (Example: "Johnny Jones"), the 'S' shall be used by the next player.

Players shall not use the words "the", "band" and "group" to begin or end artists' names during the game. (Example: "The Bud Smith Band" would be classified as "Bud Smith" and the letter 'H' used by the next player.)

Potential opportunities abound during the game for players to earn bonus cash. The Triple Play rewards players for their ability to name musical artists whose complete titles begin and end in the same letter. Players are penalized when a Triple Play opportunity is not converted. These opportunities exist in normal rotation only.

Should a player name a band/artist whose complete title begins and ends with the same letter (Example:

"Green Frog"), that player collects a $5000 bonus from the bank.

Should the following player take that letter and also name a band/artist whose complete title begins and ends with the same letter (Example: "Garden Bug"), that player converts the double play and collects $10,000 from the bank.

The player completing the procedure a third time consecutively (Example: "George Twigg"), completes the Triple Play and collects a $20,000 bonus from the bank. Should the player fail to convert a Triple Play opportunity, the player must pay a $5000 penalty to the Final Stage.

The next player begins the process anew.

Benefits also exist for those players able to complete their Arena Tours with a full contingent of five band members. At $50,000 per band member, the player exchanging five pieces at games' end collects $250,000! The number of band members a player accumulates is influenced by board moves and card directions.

Spaces on the game board direct players to add or remove band members. In addition, players can exercise Challenge 124 and Rescue 126 cards that add, remove, take, and protect band members. At no time can a player have more than five pieces in the concert platform. Should the board direct a player to "Add Any Piece" when the platform is full, the player instead collects $25,000 from the bank.

Circumstances may result which cause a player to empty their concert platform of all band members. Play continues normally should this occur. Should the board direct a player to "Return Any Piece" and the platform is empty, the player must pay a $5000 penalty to the Final Stage. The player does not owe a member if one is added later.

Should a player go bankrupt during the course of play, the player may return band member pieces to the bank for a cash advance. The Banker shall pay one-half of the end-game rate, or $25,000 for each piece exchanged.

Challenge 124 and Rescue 126 cards perform the functions their titles imply. Exercising them in opportune situations increase a players' chance of winning the game; often at an opponents' expense. A players' board position, cash savings, band size, and turn options can influence when and how to exercise these cards.

Most Challenge 124 and Rescue 126 cards are self-explanatory and prescribe some reward or penalty for their use. Challenge 124 cards allow players to challenge themselves (SELF-CHALLENGE cards only) or their opponents to perform some task. Rescue 126 cards enable players to name alternative musical artists as needed when beginning a turn. Rescue 126 cards also afford players the opportunity to fend off challenges and avoid other troublesome situations.

When a Challenge 124 or Rescue 126 card is entered into play, the card must be read aloud and placed faceup on the board. Upon the conclusion of a turn, the card is returned facedown to the bottom of its respective pile. Unless otherwise noted, a player shall draw either one Challenge 124 or one Rescue 126 card from the deck upon conclusion of a turn. Once the next player has successfully named a band/artist to begin their turn, no other player may draw a card.

Each player can not exceed a total number of eight Challenge 124 and Rescue 126 cards in any combination upon the conclusion of a turn. Should a player exceed this limit, the player must pay a $25,000 penalty to the final stage for each card over the limit and forfeit a corresponding number of cards. The opposing player on the right shall randomly select the card(s) to be forfeited from the players' hand. Forfeited cards are then returned to the bottom of their respective piles. Players must count their cards upon request.

Spaces on the game board will direct players to draw Challenge 124 and Rescue 126 cards. Should a player land on such a space, the player must draw the appropriate card. The player's turn is then automatically ended. No additional cards are drawn or played. Should the player now be in violation of the eight card limit, the penalties described above apply.

Challenge 124 cards requiring a player to "Name Three Additional Band/Artists" do not alter the normal rotation of play. After that turn is completed, the next player must use the last letter of the musical artist named to begin the previous turn; not the letter of any of the artists named in response to the challenge. In addition, Triple Play rewards do not apply when fulfilling a "Name Three Additional Band/Artists" challenge.

The sheer quantity and diversity of past and present musical artists creates a huge pool from which players can draw when naming bands and artists. No player can reasonably expect to know, remember, or recognize them all. During play, the possibility exists for a player to name a musical artist an opponent does not recognize. For this reason, the "Battle of the Bands" and "Critics Choice" cards are available to insure fair play.

Challenge cards entitled "Battle of the Bands" may be exercised when a player questions the authenticity of a musical artist an opponent has named. The "Battle of the Bands" card may be used by any player at any time. Only the first player to announce the Battle aloud while presenting the card may do so on a particular turn. When a "Battle of the Bands" card is played, the challenging player can not draw a replacement card from the deck.

When Battle is declared, the challenged player must attempt to verify the authenticity of the named musical artist. To win the Battle, the challenged player must convince a simple majority of his/her opponents that the title in question is a bona fide musical artist. Means of defending a named artist are limited only by a player's knowledge and imagination. Often, naming a song by the artist or a member of the artist's group satisfies the majority. Other times, more elaborate displays of a player's knowledge and/or creativeness are needed. If all else fails, begging may garner sympathy votes! Opponents can not deny common knowledge.

Should a majority of the challenged player's opponents accept the proof given (a quick show of hands will suffice), the challenger is defeated and must pay a $10,000 Harassment penalty directly to the challenged player. The challenged player is then free to exercise the normal turn options.

Should the challenged player fail to convince the majority of a named artist's authenticity, or a tie results, the challenged player may submit a rescue card entitled "Critics Choice". A "Critics Choice" card rebuffs a "Battle of the Bands" and does not require the challenged player to mount a defense; even if the band/artist in question is obscure, unknown, or a product of the player's imagination! When a "Critics Choice" card is played, no monetary penalty is charged to either player. The challenged player may then exercise the remaining available turn options.

Finally, should a majority of opponents reject the proof given, and the challenged player does not possess or chooses not to play a "Critics Choice" card, the challenged player must submit any other Rescue card from his/her hand to aid in naming an alternative band-/artist. For losing the Battle, the challenged player must pay a $10,000 Embarrassment penalty directly to the challenger. In addition, the challenged player is responsible for any penalty the Rescue card prescribes for its use. The challenged player may then exercise the remaining available turn options.

Challenge cards entitled "Take the Stage" may be used by players only when exercising their turns in normal rotation. When a player is challenged to "Take the Stage", that player must move his/her concert platform to the nearest Stage (count the number of board spaces to determine the closest one) and perform as directed. The first player to land on each Stage collects the $20,000 bill placed there by the Banker.

"Take the Stage" cards can not be used to move a concert platform to the Final Stage; nor served on a player waiting out a "lost turn". A player does not Take the Stage to respond to all challenges; only those where the card or board specifically says to do so. In addition, a player can not move his own concert platform to a Stage unless he/she plays an lands on a board space directing him/her to do so.

A player can move laterally either forward or backward from the Stage (see the arrows on the game board) depending upon their "Take the Stage" performance. A successful performance or correct answer allows the challenged player to move ahead on their next turn. An unsatisfactory performance or incorrect answer forces the challenged player to exit the Stage from the rear before again moving forward.

The challenged player's opponents shall judge the performance or answer in a fair and equitable manner. A majority shall decide whether the challenged player moves forward or falls back on the player's next turn. All ties go to the challenging player. Common knowledge can not be denied.

Rescue cards entitled "Stage Fright" may be used as needed by a challenged player to block a "Take the Stage" order. Entering a "Stage Fright" card into play allows the challenged player to maintain board position and refrain from giving the requested performance. No penalty is exacted from either player when a "Stage Fright" card is played. The challenged player can not draw a replacement card from the deck if he/she is responding to a "Take the Stage" card. "Stage Fright" cards increase in value as players near the Final Stage.

Having thus described the invention, what is claimed and desired to be secured by Letters Patent is:

1. A method of playing a board game comprising:

(a) providing a playing board having multiple contiguous playing spaces, with multiple stage spaces interspersed between playing spaces, a starting space and a final stage space;

(b) selecting the order in which a player will move by the throw of a pair of dice;

(c) providing each player with a quantity of play money;

(d) providing a player marker of different color for each player;

(e) providing written instructions to the player in each playing space on which a player lands;

(f) each player beginning play from the start space by a throw of the dice and moving in a generally clockwise manner around the board;

(g) providing Challenge cards and Rescue cards on the board; wherein some of the cards have questions and instructions requiring a player to move to a stage space and answer a question while on the stage space;

(h) providing play money to each player at the start of the game;

(i) providing band member pieces for insertion into a player's marker;

(j) each player at the beginning of a turn, naming a band or musical artist aloud and then rolling the dice and moving his marker forward the number of spaces shown on the dice, the player being able to substitute a Rescue card if he cannot name a band or musical artist;

(k) the player performing in the manner described in the space in which his marker lands and drawing either the Challenge or the Rescue card to conclude the turn;

(e) all following players beginning their turn by naming a band or musical artist whose first word begins with the last letter of the band or musical artist named by the preceding player, the player playing a Rescue card in his possession if he is unable to name a band or musical artist with the required first letter;

(m) the player adding or subtracting band members from his marker as directed by the play of the game;

(n) the game ending when all the players remaining in the game reach the final stage, the player amassing the most money being declared the winner.

2. The method of playing a board game according to claim 1, wherein there are two to six players and each player starts with $100,000.00 in play money, two band members in his marker and three Challenge and Two Rescue cards.

3. The method of playing a board game according to claim 1, wherein a player must state the band or musical artist within a specified period of time.

4. The method of playing a board game according to claim 1 wherein a player is disqualified from further play by failing to name a band or musical artist or play a Rescue card during his turn.

5. The method of playing a board game according to claim 1, wherein a player obtains a bonus of prize money when he names a band or musical artist whose name begins and ends with the same letter.

* * * * *